US010436163B2

(12) United States Patent
Serra et al.

(10) Patent No.: US 10,436,163 B2
(45) Date of Patent: Oct. 8, 2019

(54) FUEL RAIL ASSEMBLY FOR AN INTERNAL COMBUSTION ENGINE

(71) Applicant: CONTINENTAL AUTOMOTIVE GMBH, Hannover (DE)

(72) Inventors: Giandomenico Serra, Ghezzano-S.Giulian Terme (IT); Gisella Di Domizio, San Giuliano Terme (IT)

(73) Assignee: CPT GROUP GMBH, Hannover (DE)

( * ) Notice: Subject to any disclaimer, the term of this patent is extended or adjusted under 35 U.S.C. 154(b) by 0 days.

(21) Appl. No.: 15/590,500

(22) Filed: May 9, 2017

(65) Prior Publication Data

US 2017/0328321 A1 Nov. 16, 2017

(30) Foreign Application Priority Data

May 13, 2016 (EP) ..... 16169621

(51) Int. Cl.
*F02M 55/02* (2006.01)
*F02M 61/14* (2006.01)
*F02M 69/46* (2006.01)

(52) U.S. Cl.
CPC ..... *F02M 55/025* (2013.01); *F02M 61/145* (2013.01); *F02M 69/465* (2013.01); *F02M 2200/803* (2013.01); *F02M 2200/8015* (2013.01); *F02M 2200/8023* (2013.01);
(Continued)

(58) Field of Classification Search
CPC .. F02M 55/025; F02M 69/465; F02M 61/145; F02M 2200/8084; F02M 2200/803; F02M 2200/857; F02M 2200/856; F02M 2200/8015; F02M 2200/8023
See application file for complete search history.

(56) References Cited

U.S. PATENT DOCUMENTS

2014/0261332 A1 9/2014 Ramamurthy et al.
2014/0326217 A1* 11/2014 Roseborsky ..... F02M 69/50 123/456

(Continued)

FOREIGN PATENT DOCUMENTS

CN 203499881 3/2014
DE 102014207953 A1 11/2014
EP 2466111 A2 6/2012

(Continued)

OTHER PUBLICATIONS

EP Search Report dated Jul. 8, 2016, for corresponding European Application 16169621.6.

(Continued)

*Primary Examiner* — Xiao En Mo

(57) ABSTRACT

A fuel rail assembly for an internal combustion engine is disclosed. It includes a main gallery and a plurality of fuel delivery outlets. Each fuel delivery outlet has an injector cup and an injector cup mounting connection arranged between the main gallery and the injector cup. A fixing bracket is adapted to fasten the main gallery to the engine. The fixing bracket is spaced apart from the injector cup and secured to the main gallery. A fastening element is provided to secure the fixing bracket to the engine. A rigid connection member is coupled to the fixing bracket extends between the fixing bracket and one of the injector cup and the injector cup mounting connection.

20 Claims, 2 Drawing Sheets

(52) U.S. Cl.
CPC ..... *F02M 2200/8084* (2013.01); *F02M 2200/856* (2013.01); *F02M 2200/857* (2013.01)

(56) References Cited

U.S. PATENT DOCUMENTS

| | | | |
|---|---|---|---|
| 2015/0198128 | A1 | 7/2015 | Mechi et al. |
| 2017/0248108 | A1 | 8/2017 | Di Domizio et al. |

FOREIGN PATENT DOCUMENTS

| | | | |
|---|---|---|---|
| JP | 207040249 | | 2/2007 |
| JP | 2011226425 | A | 11/2011 |
| JP | 2015034533 | A | 2/2015 |
| KR | 20150036209 | A | 4/2015 |

OTHER PUBLICATIONS

Office Action, dated Mar. 15, 2018, for counterpart KR patent application 10-2017-0058319.
Chinese Office Action dated Jan. 24, 2019 for corresponding Chinese application No. 201710334074.2.
Korean Notice of Allowance dated Oct. 1, 2018 for corresponding Korean application No. 10-2017-0058319.

* cited by examiner

FUEL RAIL ASSEMBLY FOR AN INTERNAL COMBUSTION ENGINE

CROSS-REFERENCE TO RELATED APPLICATIONS

This U.S. patent application claims priority, under 35 U.S.C. 119, to European patent application No. 16169621.6, filed May 13, 2016, which is hereby incorporated by reference herein.

FIELD OF INVENTION

The present disclosure relates to a fuel rail assembly for an internal combustion engine and particularly, but not exclusively, to a fuel rail assembly for a multi-cylinder gasoline direct injection engine.

BACKGROUND

The fuel rail assembly includes an elongate main gallery which forms a fuel reservoir and fuel is supplied at high-pressure into the fuel rail by a fuel pump. Spaced along the fuel rail are a plurality of fuel delivery outlets for hydraulically coupling the main gallery to the individual fuel injectors which are operable to inject fuel into the engine.

Such fuel rail assemblies are typically designed according to the engine packaging and design of the specific internal combustion engine for which the assembly is required. As a result, the design of the fuel rail assembly is specific to a particular engine and is therefore not usable for other engines.

A known example of such a fuel rail assembly is disclosed in EP 2466111 B. The specification discloses a mounting structure for mounting connections for each fuel injector in the form of an injector cup to the main gallery and for securing the injector cup to the main gallery. A fastening arrangement is disclosed for securing the fuel rail to an engine and to secure the fastening arrangement to the injector cup. The fastening arrangement is spaced from the main gallery, so that concentration of stresses due to relative displacements between the parts is distributed through the various components. The mounting structure and the fastening arrangement are formed of complex bodies typically formed by forging or machining from solid which require complex tooling and machining requirements to ensure the accuracy of the components for easy assembly.

SUMMARY

One objective of the present disclosure is to provide a fuel rail assembly which is easily configurable for use with engines of different shapes and packaging requirements and which is particularly cost effective to manufacture and assemble.

A further problem associated with gasoline direct injection engines arises because of the high pressure of the fuel in the fuel rail. In a typical design, the inlet end of a fuel injector is located in a fuel injector cup secured to the main gallery and variations in the fuel pressure in the fuel injector cup and in the pressure in the hydraulic passage to the fuel injector are caused by the fuel injection process. This high-pressure and variations in the pressure creates additional stresses on the mounting and the connections between the components.

It is also an objective of the present disclosure to provide a fuel rail assembly in which the stresses imposed on the mounting structure by variations in hydraulic pressure in the injector cup are spread through the injector cup mounting.

According to example embodiments of the present invention, there is provided a fuel rail assembly for an internal combustion engine including an elongated main gallery and a plurality of fuel delivery outlets spaced along the main gallery for hydraulically coupling the main gallery to fuel injectors which are operable to inject fuel into the combustion engine, each fuel delivery outlet having an injector cup for receiving a fuel inlet of a respective one of the fuel injectors, and an injector cup mounting connection arranged between the main gallery and the injector cup for hydraulically and mechanically coupling the injector cup to the main gallery. The fuel rail assembly further includes a fixing bracket adapted to fasten the fuel rail to the engine, the fixing bracket being spaced apart from the injector cup and being secured to the main gallery with a fastening element to secure the fixing bracket to the engine, and a rigid connection member coupled to the fixing bracket and extending between the fixing bracket and one of the injector cup and the injector cup mounting connection, in particular to establish a rigid connection between the injector cup and the fixing bracket.

The main gallery may be a straight tube. In one embodiment, the injector cup and the injector cup mounting connection are separately manufactured and inseparably joined parts. For example, the injector cup mounting connection is a metal part including a fuel channel for leading fuel from the main gallery to the injector cup. In one development, the fuel channel has two sections which extend at an angle, in particular perpendicular to one another, so that the flow direction in which the fuel enters the injector cup mounting connection from the respective fuel delivery outlet is different from the flow direction in which the fuel leaves the injector cup mounting connection into the injector cup.

That "the rigid connection member extends between the fixing bracket and one of the injector cup and the injector cup mounting connection" means in particular that the connection member is fixed to one—and only one—of the injector cup and the injector cup mounting connection, is spaced apart from the other one of the injector cup and the injector cup mounting connection and extends—preferably in the elongation direction of the main gallery—from the injector cup and/or the injector cup mounting connection to the fixing bracket. In embodiments in which the connection member is fixed to the injector cup mounting connection, the rigid connection between the injector cup and the fixing bracket is in particular established by means of a rigid connection between—or integral forming of—the injector cup and the injector cup mounting connection, a rigid connection between the injector cup mounting connection and the connection member, and a rigid connection between—or integral forming of—the connection member or the fixing bracket.

In a preferred embodiment, the fixing bracket includes a U-shaped member in cross-section and defines a channel through which the fastening element passes to secure the bracket to the engine, the bracket having a first leg secured to the fuel rail and a second leg joining the connection member, the lower end of the U-shaped member adapted to abut the engine being shaped outwardly to form a flange to create a wide surface area to provide better contact between the fastening bracket and the engine, and the upper end of the U-shaped member being shaped outwardly to provide a flange to create a larger contact area for a clamping head of the fastening element.

In one embodiment, the connection member is in direct mechanical contact with the fixing bracket, e.g., it abuts the fixing bracket. In another embodiment, the connection member is integral with the fixing bracket. In a further embodiment, the fixing bracket and the rigid connecting member are integrally formed as a one-piece member stamped or pressed from sheet material.

In particular, in the case that the connection member and the fixing bracket are integral or integrally formed as a one-piece member from stamped or pressed sheet material, the expression "the fixing bracket being spaced apart from the injector cup" means in particular that the one-piece workpiece of the fixing bracket and the connection member has a receptacle portion for receiving the fastening element representing the fixing bracket and a connection portion representing the connection member, with the receptacle portion being spaced apart—in particular in the elongation direction of the main gallery—from the injector cup.

In a preferred construction, the fixing bracket is formed of sheet material—in particular of sheet metal—stamped or pressed into the required shape. The connection member may also be formed of sheet material—in particular of sheet metal—stamped or pressed into the required shape.

In a preferred embodiment, the injector cup and the injector cup mounting connection are brazed together and the mounting connection is brazed to the main gallery. In this way, a fluid tight seal in the hydraulic passage between the main gallery and the fuel injector valve is achieved.

The details of one or more implementations of the disclosure are set forth in the accompanying drawings and the description below. Other aspects, features, and advantages will be apparent from the description and drawings, and from the claims

BRIEF DESCRIPTION OF THE DRAWINGS

Preferred embodiments of the present invention will now be described by way of example with reference to the accompanying drawings, in which.

DETAILED DESCRIPTION

Figure 1:
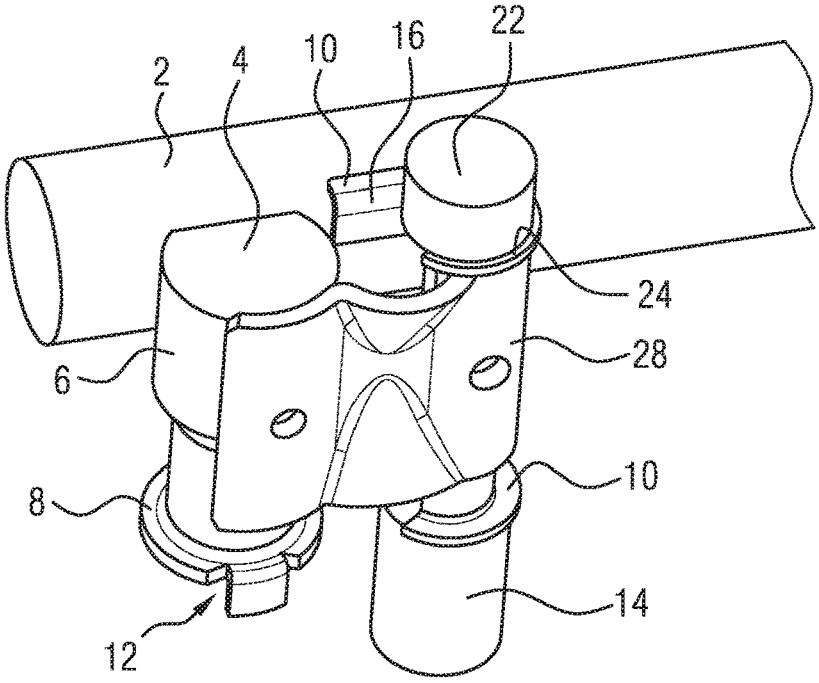
FIG. 1 shows a perspective view of a fuel rail assembly.

Referring now to FIG. 1, there is shown a main gallery 2 of fuel rail assembly, for a gasoline direct injection internal combustion engine, which is composed of an elongate metal tube comprising a fuel reservoir. Fuel at a high-pressure is supplied to the main gallery by a high pressure pump (not shown). Spaced along its length, the main gallery 2 has a plurality of fuel outlets 4 each of which is connected to a fuel delivery passage by which fuel is supplied to the fuel injectors. In this installation, the main gallery 2 is intended for a direct injection gasoline engine in which the fuel injectors (not shown) are operable to inject fuel directly into a respective combustion chamber of the engine. Only one of the fuel delivery systems, for one cylinder is shown but it will be understood that there will be one such system for each cylinder of the engine. In other embodiments, the fuel injectors will inject fuel into the engine manifold.

As shown, a metallic injector cup 8 having a generally cylindrical form contains at its downstream end in the direction of fuel flow into the engine, an internal recess 12 adapted to receive a fuel inlet part of a fuel injector (not shown). The fuel injector is secured in the cylinder head of the engine so as to project into the combustion chamber. The injector cup 8 is secured by brazing to a metallic injector cup mounting connection 6 which, in turn, is brazed to the main gallery 2 over a fuel outlet in the main gallery 2 to thus provide a hydraulic connection between the main gallery 2, the injector cup 8 and hence the fuel injector. The use of brazing to connect the injector cup mounting connection 6 to the main gallery 2 and to connect the injector cup 8 to the mounting connection 6 ensures a hydraulic fluid tight seal in the hydraulic passage between the main gallery 2 and the inlet end of the fuel injector.

Figure 2:
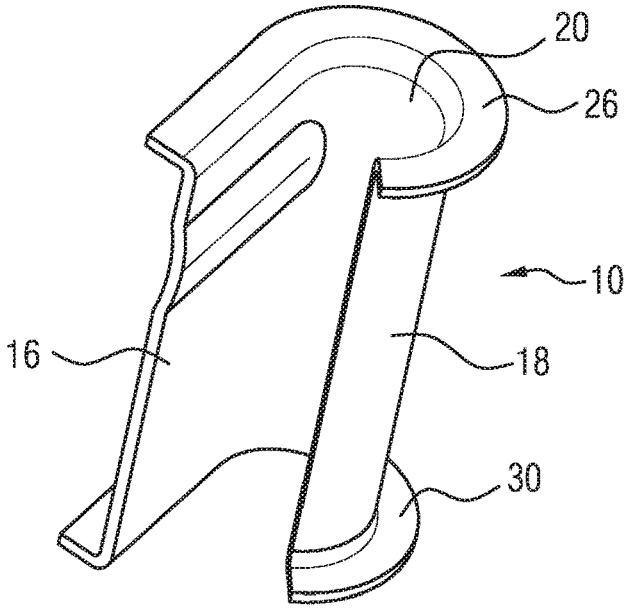
FIG. 2 shows a perspective view of a fixing bracket of the fuel rail assembly for fixing the fuel rail to an engine.

To fasten the fuel rail to the engine, there is shown a fixing bracket 10, illustrated particularly in FIG. 2, which fastens the main gallery 2 to the cylinder head of an engine shown schematically as reference 14. As shown in FIG. 2, the fixing bracket 10 is composed of an elongate member, essentially U-shaped in cross-section having one leg 16 by which the bracket 10 is secured to the main gallery 2. The method of securing may be brazing but various techniques may be used as the connection is required only to be a mechanical connection. The other leg 18, in conjunction with the web joining the two legs 16, 18, forms in cross-section an arcuate member which defines a channel 20 through which a fastening element in the form of a bolt 22 passes to secure the bracket to the engine 14.

In the present embodiment, the leg 16 by which the bracket 10 is secured to the main gallery 2 has a recess extending completely along its elongation direction. The shape of the recess preferably corresponds to the shape of a portion the external circumferential surface of the main gallery 2. The recess thus may be in full area contact with the main gallery 2. In this way, a particularly reliable connection between the fixing bracket 10 and the main gallery 2 is achievable. Also, a desired orientation of the fixing bracket 10 with respect to the main gallery 2 can be easily and reproducibly set during manufacturing of the fuel rail assembly by means of the matching shapes of the main gallery 2 and the recess.

To ensure a good contact between the underside of the bolt head 24 and the bracket 10, the upper end of the fixing bracket 10 has an outwardly extending flange 26 on which the bolt head 24 sits, which flange extends substantially at right angles to the axis of the channel 20 and the bolt 22. Similarly, at its lower end, the bracket has an outwardly extending flange 30 which extends substantially at right angles to the axis of the channel 20 and which is adapted to sit on the engine to form a good contact surface when the fixing bracket 10 is secured to the engine. These greater contact surfaces serve to spread the clamping forces which provide greater security and tends to reduce the transmission of stress and vibration between the engine and the fuel rail. Nevertheless, the fixing bracket 10 with the outwardly extending flanges 26, 30 can be cost-efficiently produced from sheet-metal, for example.

As shown in FIG. 1, the fixing bracket 10 is coupled to the injector cup mounting connection 6 by means of a rigid connection member 28 which is secured to the injector cup mounting connection 6 by brazing and is secured to the fixing bracket 10, also preferably, by brazing although alternative fixing methods may be used.

Figure 3:
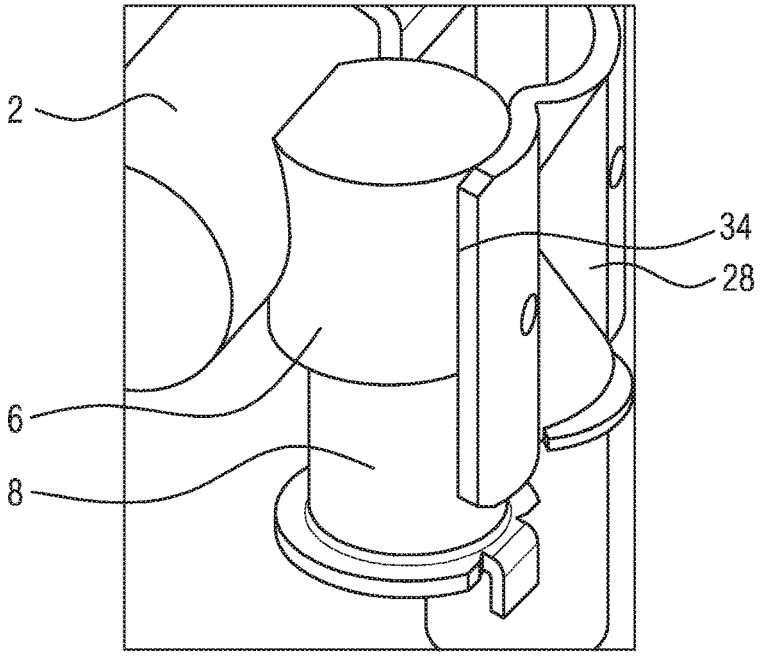
FIG. 3 shows a schematic view of a connection member of the fuel rail assembly secured to an injection cup mounting structure brazed to the main gallery of the fuel rail assembly.

In this way, stresses introduced in the injector cup mounting connection 6 and by vibration of the fuel rail relative to the engine are absorbed both by the mounting connection 6 itself and by the fixing bracket 10. This also has the advantage that stresses caused by the tendency of the injector cup 8 to move relative to the mounting connection 6 caused by variations in the hydraulic pressure within the injector cup are absorbed both by the connection of the mounted connection 6 to the main gallery 2 and by the fixing bracket 10. As shown in FIG. 3, the connection member 28 is secured, typically by brazing, solely to the injector cup mounting connection 6 at the fixing position 34. Connecting member 28 is spaced apart from the injector cup 8, in particular in a direction away from the main gallery 2 in which the main gallery 2, the injector cup 8 and the connection member 28 follow one another in this order.

Figure 4:
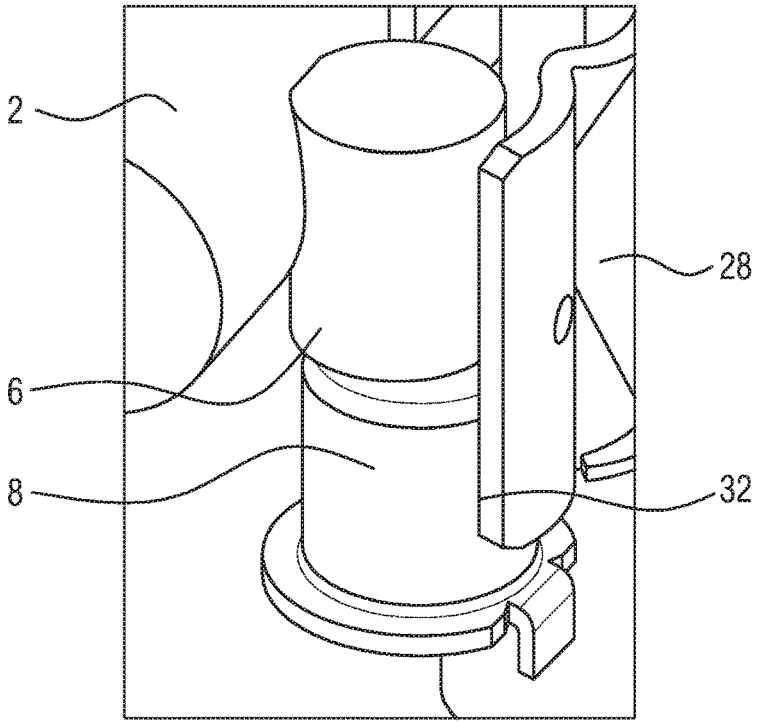
FIG. 4 shows a schematic view of a connection member of the fuel rail assembly secured to an injection cup thereof.

In an alternative embodiment as shown in FIG. 4, the connecting member 28 is connected solely to the injector cup 8 at an alternative fixing position 32, again by brazing. In this embodiment, the connecting member 28 is spaced apart from the injector cup mounting connection 6, in particular in a direction away from the main gallery 2 in which the main gallery 2, the injector cup mounting connection 6 and the connection member 28 follow one another in this order.

By securing the connection member 28 to either the injector cup mounting connection 6 or the injector cup 8 itself, assembly of the components is greatly facilitated. Since the connection member 28 only adjoins one and only one of the injector cup mounting connection 6 and the injector cup 8, the assembly may be particularly insensitive to manufacturing tolerances.

In an alternative embodiment, not shown, the fixing bracket 10 and the rigid connecting member 28 are integrally formed as a one-piece stamping or pressing from sheet material.

The manufacture of the fixing bracket 10 and the rigid connection member 28 from sheet material by a relatively easily produced stamped or pressed process, not only enables these components to be extremely cost effective to produce, it also makes variations to the mounting of a fuel rail to different engine designs economic to achieve merely by redesigning the easily manufactured fixing bracket and/or connection member. This would facilitate the use of a common fuel rail, injector cup and injector cup mounting connection in different engines to achieve economies of scale.

The foregoing embodiments have been shown and described for the purposes of illustrating the structural and functional principles of the present invention, as well as illustrating the methods of employing the embodiments and are subject to change without departing from such principles. Therefore, this invention includes all modifications encompassed within the scope of the following claims.

The invention claimed is:

1. A fuel rail assembly for an internal combustion engine, comprising:

an elongated main gallery and a plurality of fuel delivery outlets spaced along the main gallery for hydraulically coupling the main gallery to fuel injectors which are operable to inject fuel into the combustion engine, each fuel delivery outlet having an injector cup for receiving a fuel inlet of a respective one of the fuel injectors, and an injector cup mounting connection arranged between the main gallery and the injector cup for hydraulically and mechanically coupling the injector cup to the main gallery, a fixing bracket configured to fasten the main gallery to the engine, the fixing bracket being spaced from the injector cup and being secured to the main gallery, with a fastening element to secure the fixing bracket to the engine, and a connection member coupled to the fixing bracket and disposed between the fixing bracket and one of the injector cup and the injector cup mounting connection, to establish a rigid connection between the one of the injector cup and the injector cup mounting connection and the fixing bracket, wherein the injector cup and the injector cup mounting connection are brazed together and the mounting connection is brazed to the main gallery so as to provide a fluid tight seal for the hydraulic passage between the main gallery and the fuel injector.

2. The fuel rail assembly according to claim 1, wherein the fixing bracket comprises a U-shaped member in cross-section and defines a channel through which the fastening element passes to secure the fixing bracket to the engine, the fixing bracket having a first leg secured to the main gallery and a second leg joining the connection member, a lower end of the fixing bracket configured to abut the engine and being shaped outwardly to form a first flange to create a wider surface area to provide contact between the fastening bracket and the engine, and an upper end of the fixing bracket being shaped outwardly to form a second flange to provide a larger contact area for a clamping head of the fastening element.

3. The fuel rail assembly according to claim 1, wherein the connection member is integral with the fixing bracket.

4. The fuel rail assembly according to claim 1, wherein the fixing bracket is formed of plate material stamped or pressed into a required shape.

5. The fuel rail assembly according to according to claim 1, wherein the connection member is formed of plate material stamped or pressed into a required shape.

6. The fuel rail assembly according to claim 1, wherein the connection member is spaced apart from the other one of the injector cup and the injector cup mounting connection.

7. The fuel rail assembly according to claim 1, wherein the connection member extends in an elongation direction of the main gallery from the one of the injector cup and the injector cup mounting connection to the fixing bracket.

8. The fuel rail assembly according to claim 1, wherein the connection member extends in a direction other than an elongation direction of the main gallery, from the one of the injector cup and the injector cup mounting connection to the fixing bracket.

9. The fuel rail assembly according to claim 1, wherein the connection member is integral with the fixing bracket, and the fixing bracket forms a receptacle portion in which the fastening element is received.

10. The fuel rail assembly according to claim 9, wherein the receptacle portion is spaced apart from the injector cup.

11. A fuel rail assembly for an internal combustion engine, the internal combustion engine including or associated with a plurality of fuel injectors for injecting fuel therein, the fuel rail assembly comprising:

an elongated main gallery and a plurality of fuel delivery outlets spaced along the main gallery for hydraulically coupling the main gallery to the fuel injectors, each fuel delivery outlet having an injector cup for receiving a fuel inlet of a respective one of the fuel injectors, and an injector cup mounting connection arranged between the main gallery and the injector cup for hydraulically and mechanically coupling the injector cup to the main gallery, a fixing bracket configured to fasten the main gallery to the engine, the fixing bracket being secured to the main gallery, and the fixing bracket configured to be secured to the engine with a fastening element, and a connection member coupled to and disposed between the fixing bracket and one of the injector cup and the injector cup mounting connection, the connection member establishing a rigid connection between the one of the injector cup and the injector cup mounting connection and the fixing bracket, wherein the fastening element includes a clamping head, a lower end of the fixing bracket is configured to abut the engine and is shaped to extend radially outwardly to form a first flange to create a wider surface area for contacting the engine, and an upper end of the fixing bracket is shaped to extend radially outwardly to form a second flange to for contacting the clamping head of the fastening element.

12. The fuel rail assembly according to claim 11, wherein the fixing bracket comprises a U-shaped member in cross-section and defines a channel through which the fastening element passes to secure the fixing bracket to the engine, the fixing bracket having a first leg secured to the main gallery and a second leg joining the connection member.

13. The fuel rail assembly according to claim 11, wherein the connection member is integrally formed with the fixing bracket.

14. The fuel rail assembly according to claim 11, wherein the injector cup and the injector cup mounting connection are brazed together and the mounting connection is brazed to the main gallery so as to provide a seal for fuel passage between the main gallery and the fuel injector.

15. The fuel rail assembly according to claim 11, wherein the connection member extends in an elongated direction of the main gallery from the one of the injector cup and the injector cup mounting connection to the fixing bracket.

16. The fuel rail assembly of claim 1, wherein the one of the injector cup and the injector cup mounting connection is the injector cup mounting connection.

17. The fuel rail assembly of claim 6, wherein the connection member is positioned adjacent to a portion of each of the injector cup and the injector cup mounting connection, connected to the one of the injector cup and the injector cup mounting connection, and spaced apart from and does not directly contact the other of the one of the injector cup and the injector cup mounting connection.

18. The fuel rail assembly of claim 11, wherein the one of the injector cup and the injector cup mounting connection is the injector cup mounting connection.

19. The fuel rail assembly of claim 11, wherein the connection member is positioned adjacent to and covers a portion of each of the injector cup and the injector cup mounting connection, is connected to the one of the injector cup and the injector cup mounting connection, and is spaced apart from and does not directly contact the other of the one of the injector cup and the injector cup mounting connection.

20. A fuel rail assembly for an internal combustion engine, the internal combustion engine including or associated with a plurality of fuel injectors for injecting fuel therein, the fuel rail assembly comprising:

an elongated main gallery and a plurality of fuel delivery outlets spaced along the main gallery for hydraulically coupling the main gallery to the fuel injectors, each fuel delivery outlet having an injector cup for receiving a fuel inlet of a respective one of the fuel injectors, and an injector cup mounting connection arranged between the main gallery and the injector cup for hydraulically and mechanically coupling the injector cup to the main gallery, a fixing bracket configured to fasten the main gallery to the engine, the fixing bracket being secured to the main gallery, and the fixing bracket configured to be secured to the engine with a fastening element, and a rigid connection member coupled to and disposed between the fixing bracket and one of the injector cup and the injector cup mounting connection, the rigid connection member establishing a rigid connection between the one of the injector cup and the injector cup mounting connection and the fixing bracket, wherein the fixing bracket comprises a U-shaped member in cross-section and defines a channel through which the fastening element passes to secure the fixing bracket to the engine, the fixing bracket having a first leg secured to the main gallery and a second leg joining the connection member.

* * * * *